United States Patent [19]

Harper

[11] 4,245,138

[45] Jan. 13, 1981

[54] TACTILE ELEMENT AND KEYBOARD INCLUDING THE TACTILE ELEMENT

[75] Inventor: William P. Harper, Phoenix, Ariz.

[73] Assignee: Rogers Corporation, Rogers, Conn.

[21] Appl. No.: 961,628

[22] Filed: Nov. 17, 1978

[51] Int. Cl.[3] ..... H01H 9/00

[52] U.S. Cl. ..... 200/5 A; 200/159 R; 200/292

[58] Field of Search ..... 200/5 A, 5 R, 159 R, 200/159 A, 159 B, 292

[56] References Cited

U.S. PATENT DOCUMENTS

| | | | |
|---|---|---|---|
| 3,932,722 | 1/1976 | Obata et al. | 200/159 B |
| 4,156,802 | 5/1979 | Gilano et al. | 200/5 A |

*Primary Examiner*—Gene Z. Rubinson

*Assistant Examiner*—Morris Ginsburg

*Attorney, Agent, or Firm*—Fishman and Van Kirk

[57] ABSTRACT

A tactile snap-action element for use in keyboards, the element comprising an arcuately shaped invertible dome defining a first contour and a dome actuating protrusion defining a second contour, the protrusion being integral with the dome and being non-invertible. The element is operated by an actuation force which acts directly or indirectly through the non-inverting protrusion to invert the first contour and to provide tactile feedback. The keyboard includes a plurality of keys, each key comprising an element, a conductive circuit associated with the first contour and moveable with the inversion of the first contour to electrically contact a second conductive circuit associated with the element.

11 Claims, 6 Drawing Figures

TACTILE ELEMENT AND KEYBOARD INCLUDING THE TACTILE ELEMENT

BACKGROUND OF THE INVENTION (1) Field of the Invention

The present invention relates to keyboards including keys which provide tactile feedback to a person operating the keys. More particularly, the present invention relates to a snap-action element which provides tactile feedback. The element may be incorporated within each key of a keyboard having a plurality of keys. By way of example only, the keyboard has utility in retail outlets, airline terminals, fast-food restaurant terminals, data terminals and calculators.

(2) Description of the Prior Art

Prior art keyboards are of two basic types. One type of keyboard is an array of independent or discrete keys which are actuated to connect a circuit positioned beneath the keys. Typical uses for keyboards having discrete keys include hand held electronic calculators. The second type is a keyboard wherein a flat sheet of plastic has a legend printed thereon, the legend difining areas to be pushed to actuate keys positioned beneath the flat sheet of plastic.

In the keyboard of the type having a flat legend sheet, the legend sheet defines a plurality of points or areas on the sheet which the operator may press to actuate the key associated with the particular area or point. It is highly desirable that each key of the keyboard provide the operator of the key with tactile feedback when electrical connection is made by actuation of a key. The key which is positioned beneath the flat legend sheet provides for the connection of an electrical circuit and provides the operator of the key with tactile feedback when the electrical circuit is made.

One problem with prior art keyboards having flat legend sheets is that the keys positioned beneath the legend sheet have a complicated structure which requires many separate parts and which requires a large amount of time to assemble. The relatively large amount of time to assemble the keys is related not only to the large number of parts in the key, but also to the necessary alignment of the parts to insure proper actuation of the key. A typical keyboard includes a legend sheet which defines a plurality of points which the operator of the keyboard may push to actuate the keys located beneath the legend sheet. Typically, beneath the legend sheet is a second sheet having a plurality of small projections, the second sheet being aligned with the legend sheet to provide one projection for each legend point or area on the legend sheet. The projections face downwardly into the keyboard and provide for the actuation of an arcuately shaped discrete invertible metal dome. The keyboard includes a discrete or individual metal dome for each key. The domes are positioned on a printed circuit board which provides a first circuit which is connected to the periphery of the dome and a second circuit which is positioned beneath the center of the dome so that when the dome inverts, a connection is made between the two circuits. The individual metal domes are retained on the circuit board by adhesive tape having holes through which the upper portions of the domes protrude. The cost of such a keyboard is quite high due to the relatively high number of components, and the formidable assembly task. It should be understood that in the assembly of the prior art keyboard, the center of the domes had to be aligned precisely with the small projections in order for each key to provide for electrical connection and tactile feedback. Thus, a high level of precision is necessary in the method of assembly. Moreover, because of the numerous components, the keyboard is relatively thick and presents a cluttered appearance to the user of the keyboard. A thick keyboard requires a greater space to be provided on the surface on which the keyboard is to be mounted. Furthermore, this prior art keyboard has a tendency to register a double entry when the key is pressed. Double entry often results from misalignment of the dome with the small projections. Another reason for the double entry is that the domes of the prior art tend to oscillate or bounce when actuated thereby providing for double actuation of the key. The prior art key also tended to close without tactile feedback. Closing of the key without tactile feedback is often a result of misalignment of the small projection with respect to the dome. For example, if the small projection were positioned away from the center of the dome, the projection could actuate the key without providing the user with tactile feedback.

It should be understood that the keys are actuated by the operator pressing his finger against a point on the flat flexible legend sheet. The prior art switches had the disadvantage that the sheet had to be pressed at a point very close to the underlying projection which actuates the metal dome. With prior art keyboards, if the operator pressed his finger at a point removed from the underlying projection, not only was the desired key not actuated, but there was a significant possibility that an adjacent key would be actuated.

A second type of keyboard is of the type that includes many discrete keys. Such a keyboard is disclosed in U.S. Pat. No. 3,898,421. This patent discloses a keyboard wherein discrete keys may be pushed to invert an element comprising a spherical protuberance including an annular shoulder separated from a central portion by a flexural node to provide a double snap-action element. When the actuator is depressed by a force exerted on the central portion, the annular shoulder is moved and makes contact with a pair of fixed electrodes to make electrical contact and provide a first snap action. Thereafter, the central portion undergoes a second snap action whereby the central portion is positioned between the electrodes. It is a significant drawback of the element disclosed in this patent that the actuator undergoes two snap-actions. An operator using the key by having to press the key through two snap actions may be confused as to whether electrical contact was made once or whether electrical contact was made twice. Thus, it is undesirable to provide a central portion which is capable of inversion.

It is an object of the present invention to provide a keyboard having simplified and fewer components thereby allowing for simplified methods of assembly.

It is an object of the present invention to provide a keyboard wherein the domed actuators are not required to be aligned with actuating protrusions.

It is a further object of the present invention to provide a keyboard having keys wherein the tendency for double entry is reduced. It is another object of the present invention to reduce the possibility of the key closing without tactile feedback.

It is a further object of the present invention to provide keys which are less sensitive to the imposition of forces disposed from the center of the key. Restated, it is an object of the present invention to provide a key which may be actuated by a force imposed at an area of the legend sheet removed from the center of the actuator.

It is another object of the present invention to provide a keyboard whereby the legend sheet has a dual purpose in that the legend sheet defines actuating areas and also provides a conductive circuit.

It is a further object of the present invention to provide a keyboard having a reduced number of components thereby reducing material cost and assembly cost.

SUMMARY OF THE INVENTION

The present invention provides a keyboard including a plurality of keys, each key including a snap-action tactile actuator comprising an arcuately shaped invertible dome wherein the dome includes a dome actuating protrusion which is integral with said dome and which is non-invertible. The actuating protrusion is relatively rigid in comparison to the dome and resists inversion under normal loading while the dome inverts under normal loading. In the preferred embodiment of the invention, the dome actuating protrusion comprises a cylindrical protrusion which is integral with the dome and which extends from the center of the dome. The cylindrical walls of the dome actuating protrusion have a geometry which resists inversion under normal loading while the dome has a geometry which inverts under normal loading.

It should be understood that the above described actuator is capable of being used in many conventional key applications known in the prior art. Although the actuator of the present invention is capable of being used in devices having independent or discrete keys such as hand held calculators and the like, the actuator of the present invention is particularly adapted for use in keyboards of the type having a legend sheet which is relatively flat and which has a legend printed thereon.

In a legend sheet type keyboard, the present invention provides a particularly novel keyboard. The keyboard includes first flexible sheet having a circuit pattern disposed on one surface thereof, the sheet further including a plurality of domed actuators which may be molded in and integral with the sheet. The first sheet having domed actuators thereon is aligned with a second sheet including printed circuitry, the circuitry on the first sheet facing and being aligned with the circuitry on the second sheet to provide for connection of the circuitry when the domed actuator is actuated. The second sheet may be flexible or stiff. Preferably, the two sheets are spaced apart and held in position by an insulating adhesive which functions to insulate the circuits on the first sheet from the circuits on the second sheet except at points where the domed actuator will contact the second sheet when the domed actuator is actuated.

In one embodiment of the present invention, the keyboard is positioned so that the domed actuator protrudes toward the person operating the keyboard. In this instance, a legend sheet having a legend printed thereon is positioned above the domed actuators and the points on the printed legend are aligned with the actuators so that a person pressing the legend board deforms the actuator downwardly.

In a particularly novel second embodiment, the structure of the present invention makes a separate legend sheet unnecessary. In this embodiment, the second sheet is flexible and the legend is printed on the second sheet on the side of the second sheet opposite the circuit pattern. The keyboard is positioned so that the second sheet is presented to the keyboard operator, and the actuators are concave with respect to the person operating the keyboard. The keyboard will be placed on a supporting surface such as a cash register in a retail outlet. Thus, rather than moving the dome actuator downwardly toward the second sheet, in this embodiment, the second sheet is moved downwardly toward the domed actuator. It should be understood that in this embodiment of the invention, a separate legend sheet is no longer required. However, in applications where it is desirable to provide a separate legend sheet, that is, in applications where it is envisioned that the legend on the legend sheet will be changed, the keyboard may optionally include a separate legend sheet.

The method of assembling the keyboard of the present invention is particularly simple: the first flexible sheet of printed circuitry having the domes formed therein need only be aligned and adhered to a second sheet of printed circuitry.

BRIEF DESCRIPTION OF THE INVENTION

DETAILED DESCRIPTION OF THE INVENTION

Figure 1:
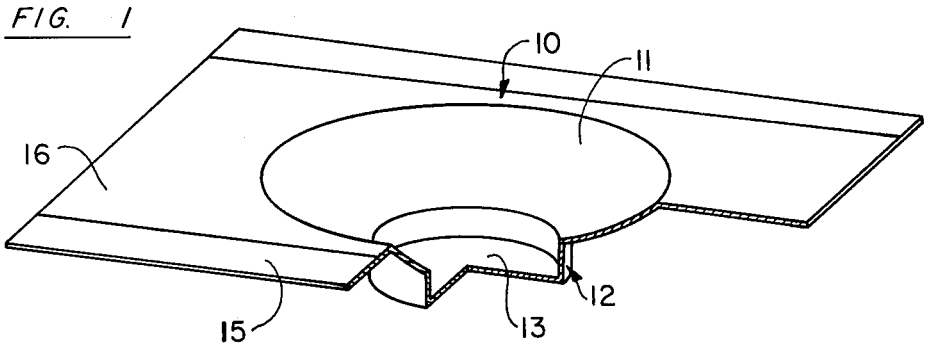
FIG. 1 shows a perspective view of an individual tactile element having one quarter of the element sectioned away.

Referring to FIG. 1, the snap-action tactile element 10 includes an arcuately shaped invertible dome 11 and a dome actuating protrusion 12 which is integral with the dome and which is noninvertible. Dome actuating protrusion 12 is rigid in comparison to dome 11 and resists inversion under normal loading while dome 11 inverts under normal loading. Protrusion 12 has a generally cylindrical shape which terminates in a flat circular surface 13. The cylindrical walls of the dome actuating protrusion 12 provide a geometry which resists inversion when an actuation force is directed along the longitudinal axis of the cylindrical walls. The dome has a geometry which inverts under normal loading. However, it should be noted that other shapes of dome actuating protrusions may be used provided the dome actuating protrusions do not invert when the actuator is operated. Actuator 10 is preferably molded by conventional means from a sheet of insulating material having conductive circuitry 16 formed thereon. The conductive circuitry will be referred to as "printed circuitry." It should be understood that the circuitry may be of a conventional type and may be formed by printed circuit techniques or other techniques known in the art such as, for example, conductive inking or die stamping. Printed circuitry 16 may cover all or a portion of the interior surface of actuator 10. Sheet 15 is preferably made from an insulating plastic material which is flexible and resilient. Sheet 15 is preferably made of polyester material sold by DuPont under the trademark MYLAR. Examples of other materials are: CELENAR (Celanese, Inc.);

POLYSULFONE (Union Carbide); POLYETHER SULFONE (ICI, Inc.); and LEXAN (General Electric Co.).

Figure 2:
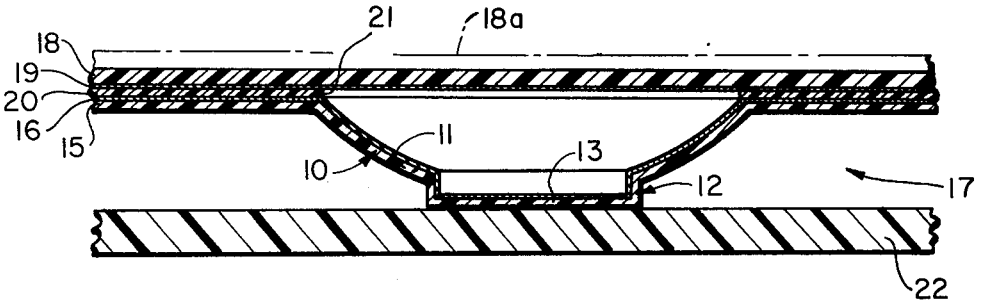
FIG. 2 shows a side sectional view of a key including the domed actuator shown in FIG. 1.
Figure 3:
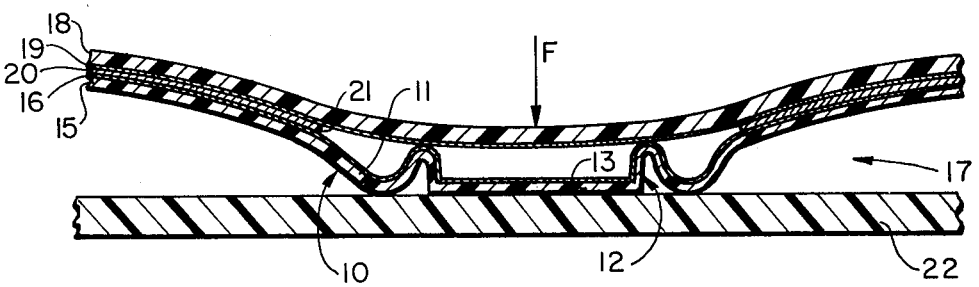
FIG. 3 shows a side sectional view of the key shown in FIG. 2, the key having been actuated.
Figure 4:
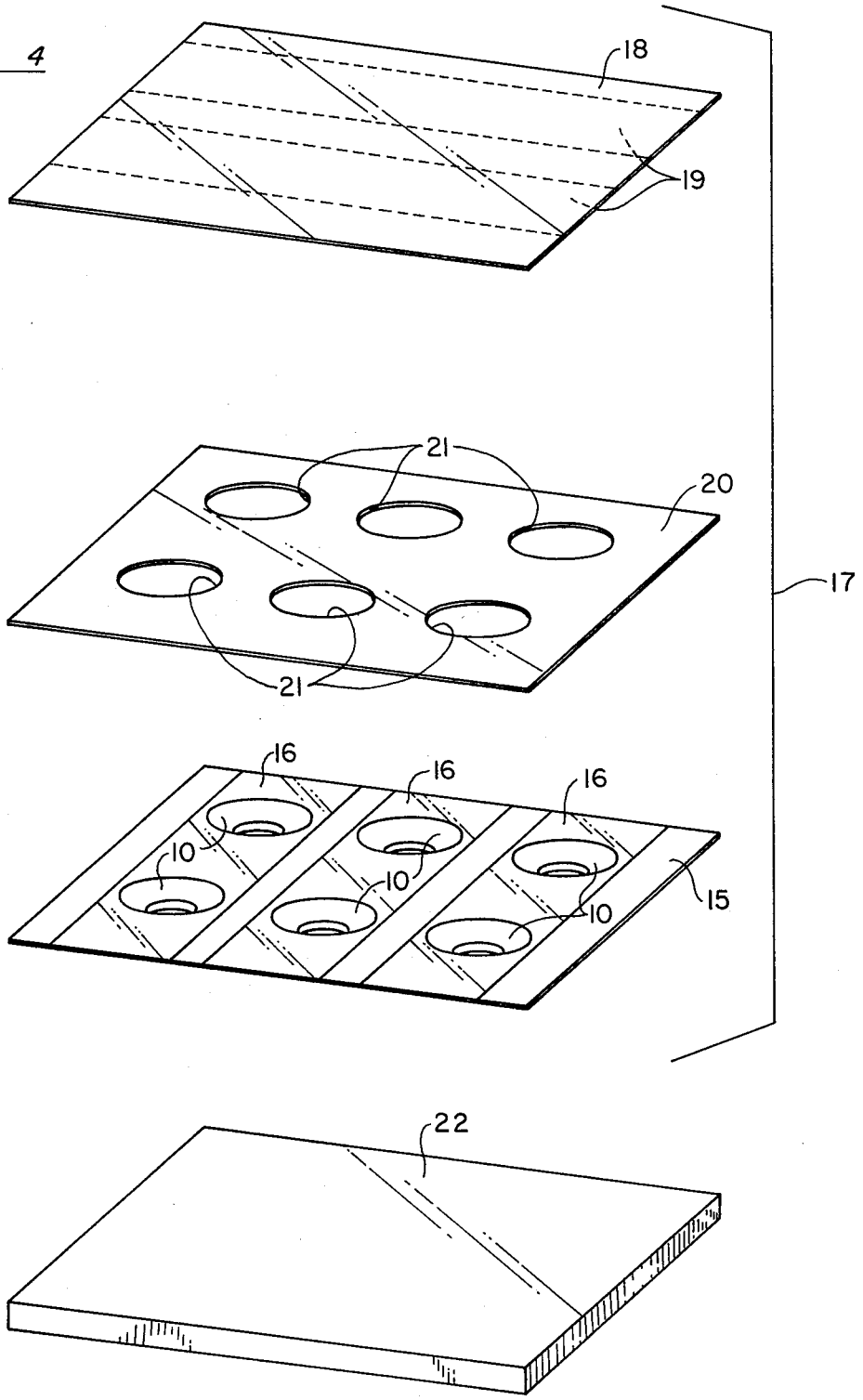
FIG. 4 is an exploded perspective view of a keyboard including the key shown in FIGS. 2 and 3.

Referring simultaneously to FIGS. 2, 3 and 4, a keyboard including a plurality of keys is shown. Keyboard 17 includes a plurality of snap-action tactile elements 10 as previously described. Keyboard 17 includes a flexible sheet 18 having printed circuitry 19 on one side thereof. Adhesive 20 insulates circuit 16 from circuit 19 and retains the sheets 15 and 18 in position with respect to each other. Adhesive 20 includes a plurality of apertures 21 which allow for movement of actuator 10 therethrough to contact sheet 15 with sheet 18 thereby connecting printed circuit 16 with printed circuit 19.

In the preferred embodiment of the invention, the adhesive is a film with appropriate die cut apertures 21. The film is adherent on both sides: one side of the film is placed in contact with one of the sheets 15 or 18 and then the other sheet is brought into contact with the other side of the film. Preferably, the film may be any one of the following, depending on the particular application: synthetic rubber base pressure sensitive; acrylic polymer base pressure sensitive; and silicone polymer base pressure sensitive. It should be understood that the adhesive may also be applied in liquid form to the surface of sheet 18 with appropriate masking for apertures 21; and subsequently, sheet 15 is positioned in contact with adhesive 20. Keyboard 17 is positioned on and secured relative to a supporting surface 22. Supporting surface 22 may represent a surface of a cash register with which the keyboard may be used; or surface 22 may be an integral part of the keyboard.

FIGS. 2 and 3 show respectively a key in the non-actuated position and the actuated position. When a downward force, F, is imposed on sheet 18, sheet 18 deforms downwardly. It should be understood that sheet 18 may include a legend printed on the surface of sheet 18 which indicates an actuation area. A person operating the keyboard applies an actuation force to this actuation area. It should be understood that the force may be applied off center from the tactile element 10 and still actuate the key. When an off center actuation force is applied to the key, the flat surface area 13 allows for the force to be relatively evenly distributed over the actuator area, thereby proving for actuation of the key (Surface area 13 is best shown in FIG. 1). As shown in FIG. 3, the arcuately shaped dome portion 11 inverts while the dome actuating protrusion 12 does not invert. The reason protrusion 12 does not invert is that the walls of a cylinder will support heavy loads without collapse. However, it should be understood that protrusion 12, as shown in FIG. 3, may deform to a slight degree to accommodate the inversion of dome portion 11. By inversion, it is meant that the direction of the curvature of at least part of the wall of dome 11 is subject to rapid change. That is the curvature of at least part of the wall of dome 11 undergoes a reversal in the direction of slope, and the reversal occurs suddenly to provide tactile feedback. Dome portion 11 travels downwardly for a very short distance before dome inversion occurs. As shown in FIG. 3, the direction of curvature of part of arcuately shaped dome portion 11 changes, i.e., reverses. However, the dome actuating protrusion 12 does not invert.

As shown in FIGS. 2, 3 and 4, sheet 18 functions both as a printed circuit and as a legend sheet. It should be understood, that in some applications, it may be desirable to include an additional legend 18*a* positioned above sheet 18. A separate legend sheet is desirable in the circumstance where the user desires to change the legend but does not desire to change the hardware beneath the legend.

Figure 5:
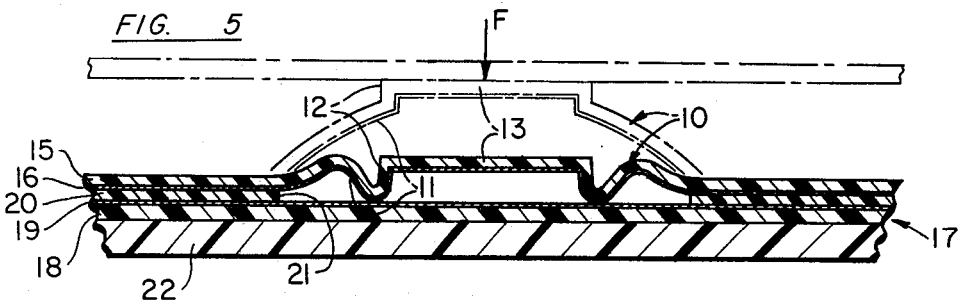
FIG. 5 is a side sectional view of another embodiment of a key.

FIG. 5 shows a side sectioned view of an actuator 10 positioned with dome 11 convex relative to the user, that is, protruding toward the user of the keyboard. It should be understood that the force, F, can be imposed by either a discrete key as is often done in calculators or by a legend sheet as previously discussed. The keyboard shown in FIG. 5, is flipped 180° from that shown in FIG. 2 but is identical to the keyboard shown in FIG. 2 except that it is no longer necessary to print a legend on sheet 18. The dash lines show the actuator in the unactuated position and with an optional legend sheet and the solid lines show the actuator in the actuated position.

Figure 6:
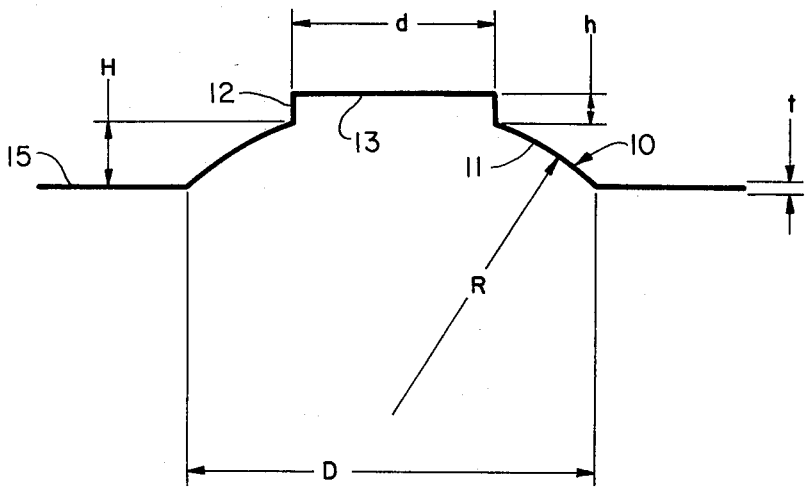
FIG. 6 is a schematic sectional view of the actuator shown in FIG. 1.

Research has determined that there is a range of preferred dimensions for the actuator. It should be understood, however, that the ranges disclosed below are merely preferred ranges, and the present invention is not limited to these ranges. Referring to FIG. 6, the arcuately shaped dome preferably has the shape of a sphere having a radius R, which should be within the range of about 0.2 to about 0.5 inches. The sphere should protrude from the sheet a height H, of between about 0.015 and about 0.065 inches. The thickness of the sheet, t, should be between about 0.002 and about 0.007 inches. The cylindrical protrusion should have a diameter, d, in the range of between about 0.125 to about 0.300 inches and a height, h, in the range of about 0.015 to about 0.050 inches.

IN general, an increase in the diameter, d, of the protrusion provides for actuation of the tactile element with a force applied further from the center of the tactile element. An increase in "d" should be accompanied by an increase in R and/or H to provide for tactile feedback. Generally speaking the height, h, of the protrusion is not critical to the tactility of the tactile element, but, dimension h must be sufficiently large so that the cylindrical protrusion exists as a separate geometry. Maximum values of h are determined by the elongation characteristics of the plastic film. In general, if the thickness, t, is increased, R, H and/or d should be increased. A decrease in the required actuation force may be accomplished by decreasing t (with attendant decreases in R, H and/or d) or may be accomplished by decreasing the ratio of d/R.

While preferred embodiments have been shown and described, various modifications and substitutions may be made thereto without departing from the spirit and scope of the present invention. Accordingly, it should be understood that the present invention has been described by way of illustration and not limitation.

What is claimed is:

1. An electrical switch, said switch providing tactile feedback to a user to indicate actuation thereof, said switch including:

a tactile element, said tactile element comprising:

a planar base sheet;

a first circular depression formed in said base sheet, said depression defining a dome having an arcuate side wall of uninterrupted smooth contour between the plane of said base sheet and a first plane parallel to the plane of said base sheet, said dome being convex when viewed from the exterior thereof; and a cylindrically shaped hollow extension of said dome, said extension also being formed of said base sheet and extending between said first plane and a second plane parallel to said first plane, said cylindrical extension including an end portion lying at least partly in said second plane, the diameter of said extension being sufficiently less than the diameter of said depression at said base sheet to permit a portion of said arcuate side wall to undergo a reversal in the direction of slope with snap-action upon application of a force to said end portion of said cylindrical extension, said extension being sized and shaped to resist deformation;

first electrical contact means in contact with at least a first surface of said dome arcuate side wall for movement therewith; and second electrical contact means supported in alignment with and normally spaced from said first contact means, the spacing between said first and second contact means being sufficient to prevent contact therebetween until after said reversal in slope of said dome arcuate side wall has occurred.

2. The switch of claim 1 wherein said end portion of said cylindrical extension comprises a circular flat surface lying in said second plane.

3. The switch of claim 1 wherein said circular depression comprises a portion of a sphere of radius R.

4. The switch of claim 2 wherein said circular depression comprises a portion of a sphere of radius R.

5. The switch of claim 4 wherein:

the radius R is between about 0.2 and about 0.5 inches;

the distance, H, between said base sheet and said first plane is between about 0.015 and about 0.065 inches;

the diameter, d, of the cylindrical extension is between about 0.125 and about 0.300 inches;

the distance, h, between said first and second planes is between about 0.015 and about 0.050 inches; and the thickness, t, of said element is between about 0.002 and about 0.007 inches.

6. A keyboard comprising:

a planar base sheet;

an array of tactile elements formed in said base sheet, said tactile elements each including;

a first circular depression, said depression defining a dome having an arcuate side wall of uninterrupted smooth contour between the plane of said base sheet and a first plane parallel to the plane of said base sheet, said dome being convex when viewed from the exterior thereof; and a cylindrically shaped hollow extension of said depression, said extension extending between said first plane and a second plane parallel to said first plane, said extension including an end portion lying at least partly in said second plane, the diameter of said extension being sufficiently less than the diameter of said depression at said base sheet to permit a portion of said arcuate side wall to undergo a reversal in the direction of slope with snap-action upon application of a force to said end portion of said cylindrical extension, said extension being sized and shaped to resist deformation;

first electrical contact means in contact with said base sheet, said first contact means including conductive material in registration with at least a portion of the arcuate side walls of each of said domes, said conductive material being movable with said side walls when they undergo the said reversal in direction of slope; and second electrical contact means supported in alignment with and normally spaced from said first electrical contact means, the spacing between said first and second contact means being sufficient to prevent contact therebetween until after said reversal in said slope of said dome arcuate side walls has occurred.

7. The keyboard of claim 6 wherein said base sheet comprises a flexible printed circuit substrate and wherein said first contact means comprises a circuit supported on said substrate.

8. The keyboard of claim 7 wherein said second contact means comprises a printed circuit and wherein said keyboard further comprises:

means for electrically isolating said first contact means from said second contact means except in the areas of said dome arcuate side walls.

9. The keyboard of claim 8 wherein said isolating means comprises a non-conductive adhesive.

10. The keyboard of claim 7 wherein said second contact means comprises a flexible printed circuit, said second contact means printed circuit having contact portions on a first surface thereof positioned in alignment with said first contact means, said second contact means further comprising means defining a legend associated with each switch, said legend defining means being supported on said printed circuit on the side opposite to said contact portions.

11. The keyboard of claim 6 wherein:

said dome is a portion of a sphere having a radius, R, between about 0.2 and about 0.5 inches;

the distance, H, between said base sheet and said first plane is between about 0.015 and about 0.065 inches;

the diameter, d, of the cylindrical extension is between about 0.125 and about 0.300 inches;

the distance, h, between said first and second planes is between about 0.015 and about 0.050 inches; and the thickness, t, of said base sheet is between about 0.002 and about 0.007 inches.

* * * * *